United States Patent [19]

Rear

[11] Patent Number: 5,056,609

[45] Date of Patent: Oct. 15, 1991

[54] VALVE ASSEMBLY FOR A DOWNHOLE TO REMOVE BORE HOLE SUBSIDENCE

[76] Inventor: Ian G. Rear, 60 Clavering Rd., Bayswater, Western Australia

[21] Appl. No.: 400,162

[22] Filed: Aug. 28, 1989

[30] Foreign Application Priority Data

Aug. 26, 1988 [AU] Australia ..... PJ0066

[51] Int. Cl.[5] ..... E21B 1/00

[52] U.S. Cl. ..... 175/296; 173/136

[58] Field of Search ..... 175/296, 293; 166/177, 166/178; 173/136, 138

[56] References Cited

U.S. PATENT DOCUMENTS

| | | | |
|---|---|---|---|
| 3,038,548 | 6/1962 | Brown | 175/296 X |
| 3,570,611 | 3/1971 | Riziue et al. | 175/296 |
| 4,660,658 | 4/1987 | Gustafsson | 175/296 |

*Primary Examiner*—William P. Neuder

*Attorney, Agent, or Firm*—Harness, Dickey & Pierce

[57] ABSTRACT

A downhole hammer having a fluid inlet controlled by a check valve. The valve assembly is used to remove subsidence from a bore hole to prevent problems caused by bore hole collapse. The valve assembly contains a housing and fluid inlet and outlet. A valve is positioned in the housing between the fluid inlet and outlet. A bypass passageway is also provided in the housing between the fluid inlet and the bore hole exterior.

8 Claims, 2 Drawing Sheets

VALVE ASSEMBLY FOR A DOWNHOLE TO REMOVE BORE HOLE SUBSIDENCE

This invention relates to downhole hammers.

It has been found that prior art downhole hammers when used in broken or loose ground conditions can become jammed as a result of the collapse of the walls of the bore hole around and above the hammer.

It is an object of this invention to provide means to assist in overcoming the difficulty caused by the collapse of a bore hole around a drill string or hammer.

In one form the invention resides in a downhole hammer having a fluid inlet controlled by a check valve wherein the check valve is adapted to be opened on a positive pressure differential existing between the inlet and the downstream side of the check valve, at least one bypass passageway provided between the inlet and the exterior of the hammer wherein said bypass passageway opens into the inlet to be closed by the check valve when said check valve is closed.

Figure 1:
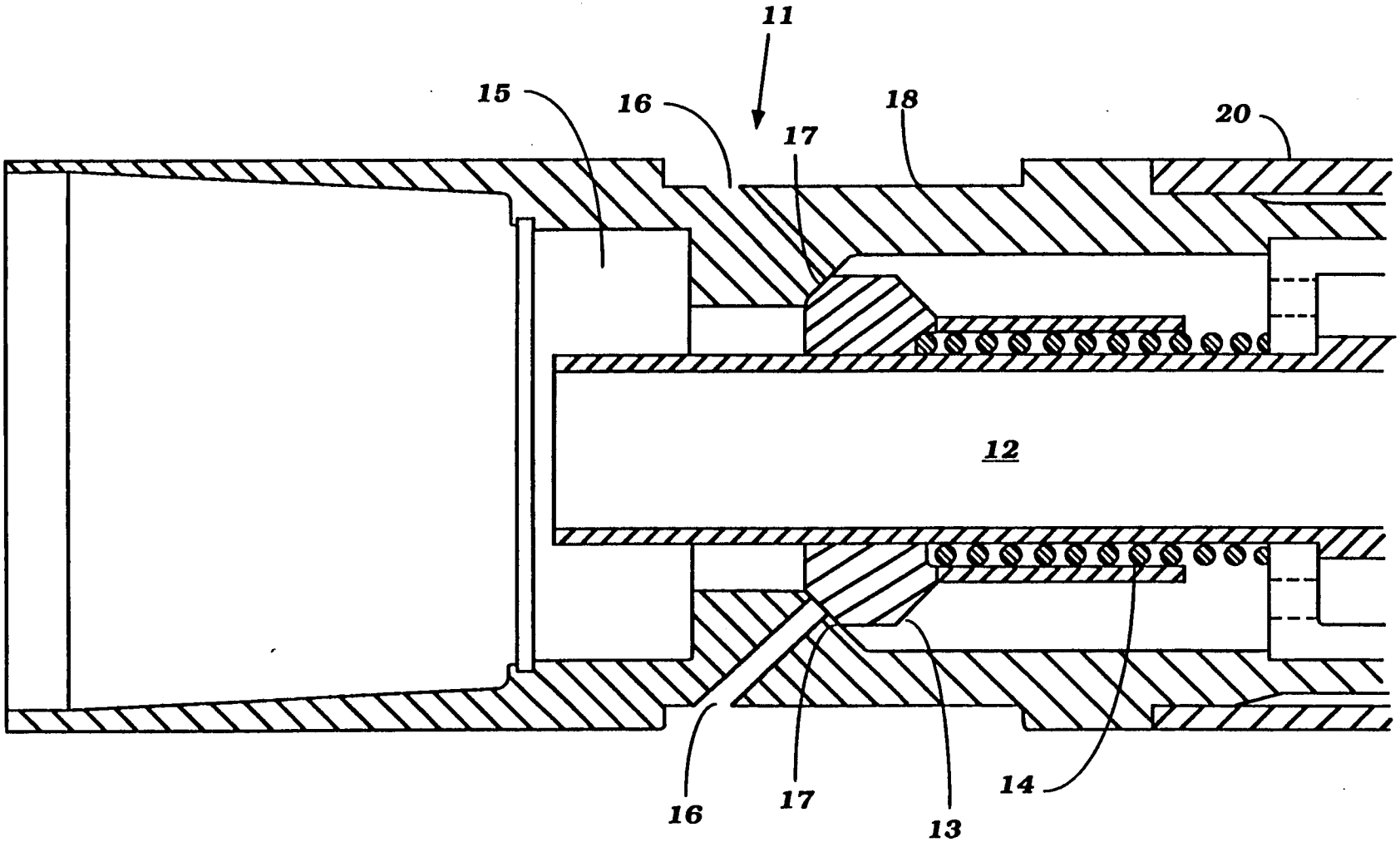
Figure 2:
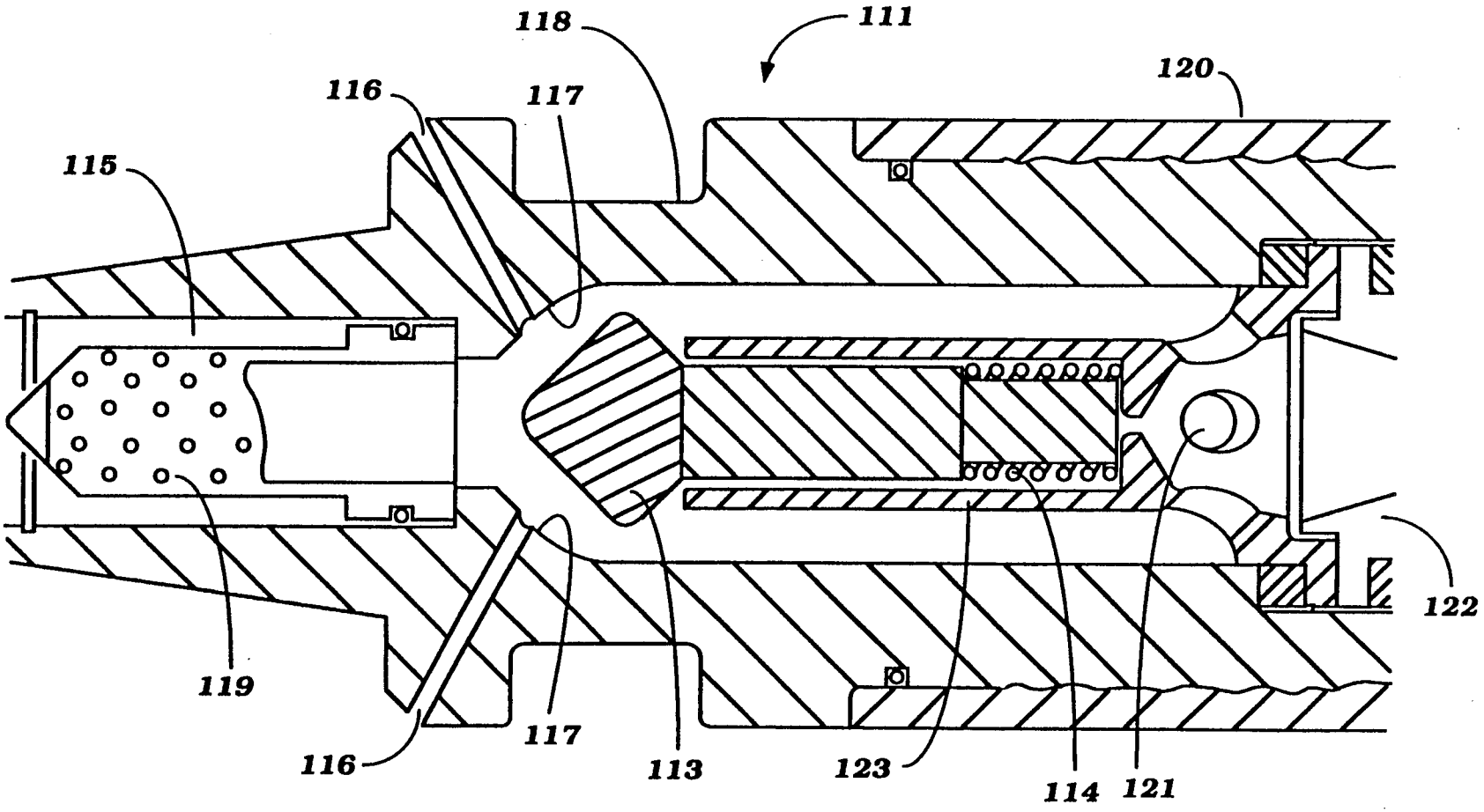

The invention will be more fully understood in the light of the following description of two specific embodiments. The description is made with reference to the accompanying drawings of which:

FIG. 1 is a part sectional elevation of a recirculating downhole hammer showing the top sub assembly of that hammer with the check valve in the closed position; and FIG. 2 is a part sectional elevation of a non-recirculating downhole hammer showing the top sub assembly of that hammer with the check valve in the open position.

The first embodiment shown at FIG. 1 is directed to a recirculating downhole hammer whereby air is introduced into the hammer through the top sub 11 and exhaust air together with entrained cuttings generated by the action of the hammer is returned to the surface through an axial return passageway 12 within the hammer which communicates with a return line (not shown) in the drill string (not shown). The top sub 11 of the hammer as shown in the drawing is adapted to be connected to a hammer casing 20 and accommodates a check valve 13 which is biassed by the action of a compression spring 14 into engagement with a valve seat at the upper end of the top sub to seal the inlet 15 of the top sub. The check valve is engagable with a valve seat 17 which is provided on the interior of the top sub casing 18. On introduction of sufficient fluid pressure to the inlet 15 the check valve 13 will be caused to move away from the valve seat 17 and open under the influence of that pressure to admit fluid into the hammer. In the event that the back pressure within the hammer results in a negative pressure differential between the inlet and the downstream side of the check valve or a pressure differential which is less than the biassing force created by the compression spring 14, the check valve 13 will close to prevent the entry of any exhaust air and cuttings into the hammer. In addition in the event that the supply of fluid pressure is terminated the check valve will close to prevent the flow of drill cuttings into the hammer.

The casing 18 of the top sub is provided with a plurality of substantially radially directed bypass passageways 16 which extend between the interior of the top sub casing 18 and the exterior of the top sub casing 18. The passageways are directed obliquely away from the central axis of the hammer in a direction opposite to that of the fluid flow into the hammer. The inner end of the passageways 16 opens into the interior of the top sub casing at the valve seat 17 whereby on the check being moved to its closed position the check valve engages with the inner ends of the passageways 16 to close such passageways. In the event that the fluid pressure applied to the inlet of the top sub exceeds the back pressure within the hammer the check valve is opened and fluid is allowed to pass into the hammer. In addition fluid also passes into the bypass passageways 16 to enter the space between the bore hole and the exterior of the hammer at a position spaced from the drill bit. As a result of the presence of the bypass passageways a fluid flow is generated up through the bore hole between the drill string and the side walls of the bore hole. Such fluid flow is significantly less than the fluid flow generated onto the hammer. In the event of at least a partial collapse of the ground through which the bore hole is being drilled the upward air flow generated from the bypass passageways 16 will carry the material which is being deposited into the bore hole around the hammer to the surface to prevent such material from falling into the space between a lower portion of the bore hole and the exterior of the drill string or hammer and which may result in jamming of the hammer and drill string in the bore hole.

The second embodiment shown at FIG. 2 relates to a non-recirculating downhole hammer in which the return air together with entrained cuttings returns to the surface through the space provided between the exterior of the hammer and the bore of the borehole.

The second embodiment comprises a top sub 111 having an inlet 115 associated with a screen 119. The inlet 115 is adapted to be fixed to the lower end of a drill string (not shown). The other end of the top sub is adapted to be fixed to the upper end of a hammer casing 120 and has an outlet 121 which opens into a feed tube 122 supported within the hammer. The outlet 121 is provided by a concentric tubular element 123 supported within the top sub casing 118 in opposed relation to the inlet 115 and which is provided at its base with a series of apertures which provide the outlet 121. The innermost end of the tubular member slidingly supports a check valve 113 which is biassed by a compression spring 114, accommodated within the tubular member, into engagement with a valve seat 117 provided on the interior of the top sub casing 118. The check valve 113 operates in a similar manner to the check valve 13 on the first embodiment.

The valve seat is associated with a set of radial bypass passageways 116 which extend between the valve seat 117 and the exterior of the top sub casing 118. The radial passageways are directed obliquely to the central axis of the top sub in a direction opposite to the fluid flow into the hammer. As in the case of the first embodiment the bypass passageways 116 permit the flow of fluid to the exterior of the top sub on the passage of fluid to the hammer. Such fluid flow supplements the flow of fluid and entrained cuttings out of the bore hole between the walls of the bore hole and the hammer and drill string to facilitate the entrainment in that fluid stream of the cuttings and any additional material which may be dislodged from the walls of the bore hole.

It should be appreciated that the scope of the present invention need not be limited to the particular scope of the embodiment described above.

I claim:

1. A valve assembly included within a downhole hammer assembly to remove subsidence from a bore hole, the valve assembly comprising:

a housing for the valve assembly having two ends, an upper end of the housing engaging a drill string and a lower end engaging a downhole hammer;

a fluid inlet means at the upper end of the housing enabling introduction of an inlet fluid into the housing from the drill string;

a fluid outlet means at the lower end of the housing enabling introduction of the inlet fluid into the downhole hammer from the fluid inlet means;

a valve in the housing between the fluid inlet means and the fluid outlet means having an open position and a closed position, wherein the valve is in the open position when a sufficient positive pressure differential exists between the fluid inlet means and the fluid outlet means thereby providing a fluid passageway for the inlet fluid from the drill string to the downhole hammer, and further wherein the valve is in the closed position at all other times thereby closing the fluid passageway; and at least one bypass passageway in the housing between the fluid inlet means and the bore exterior to the housing, wherein the at least one bypass passageway provides a bypass for a portion of the inlet fluid into the bore hole when the valve is in the open position thereby returning the portion of the inlet fluid to the surface carrying therewith any bore hole subsidence contacted by the portion of the inlet fluid, and further wherein the at least one bypass passageway is closed when the valve is in the closed position.

2. The valve assembly of claim 1 wherein a plurality of bypass passageways are provided in the housing between the fluid inlet means and the bore hole, the plurality of bypass passageways being oblique to the central axis of the valve assembly means in a direction opposite to the flow direction of the inlet fluid into the downhole hammer.

3. The valve assembly of claim 1 wherein the downhole hammer is a recirculating type.

4. The valve assembly of claim 2 wherein the downhole hammer is a recirculating type.

5. The valve assembly of claim 1 wherein the downhole hammer is a non-recirculating type.

6. The valve assembly of claim 2 wherein the downhole hammer is a non-recirculating type.

7. The valve assembly of claim 1 further comprising a biasing means to bias the valve in the closed position.

8. The valve assembly of claim 7 wherein the biasing means is a spring.

* * * * *